United States Patent [19]

Osswald

[11] Patent Number: 4,632,266

[45] Date of Patent: Dec. 30, 1986

[54] CONTAINER CAP

[76] Inventor: Otto Osswald, 515 Ocean Ave. #703, Santa Monica, Calif. 90402

[21] Appl. No.: 832,252

[22] Filed: Feb. 24, 1986

[51] Int. Cl.[4] ..... B65D 47/06

[52] U.S. Cl. ..... 215/235; 220/338; 222/534; 222/556

[58] Field of Search ..... 215/311, 313, 235, 237; 222/534, 536, 533, 556, 545; 220/338, 337

[56] References Cited

U.S. PATENT DOCUMENTS 2,765,949 10/1956 Hillman ..... 220/338

4,441,637 4/1984 Libit ..... 215/235 X

*Primary Examiner*—Donald F. Norton

*Attorney, Agent, or Firm*—Erik M. Arnhem

[57] ABSTRACT

A generally cylindrical closed ended molded plastic cap for use in a liquid storing container includes a planar sealing surface at the closed end which defines a tab recess. A substantially planar molded plastic tab configured to be pivotally mountable within the tab recess is snap fitted to the cap and is pivotable between a first position in which the cap seals the liquid storing container and a second position in which the liquid may be removed from the container. A pair of tines on the tab cooperate with a corresponding pair of grooves in the tab recess to resist stresses which tend to separate the tab from the tab recess.

7 Claims, 4 Drawing Figures

FIG. 1
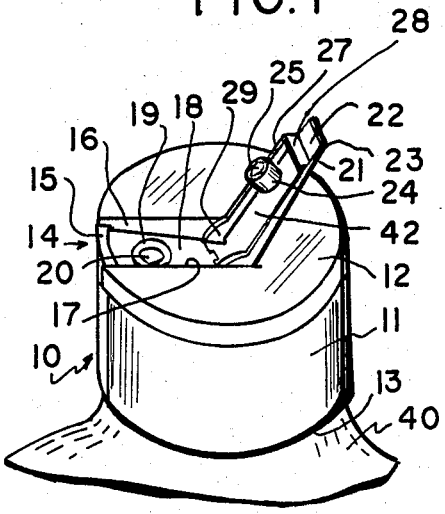
FIG. 2
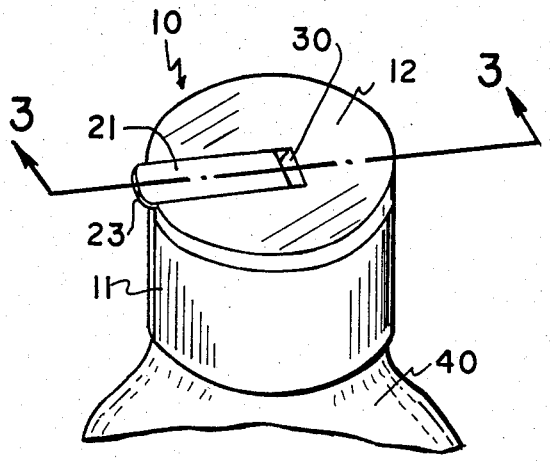
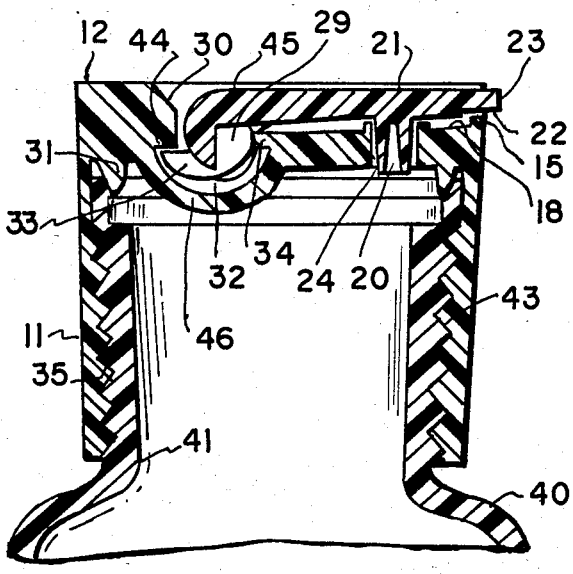
FIG. 3
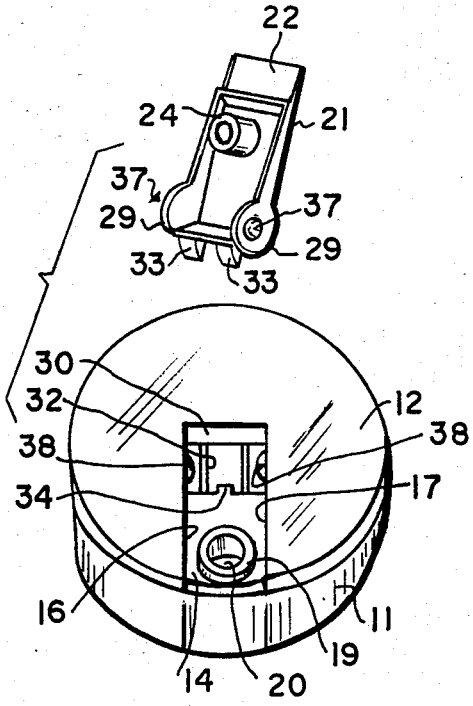
FIG. 4

CONTAINER CAP

BACKGROUND OF THE INVENTION (1) Field of the Invention

This invention relates generally to containers used to dispense and store flowing materials such as a liquid or powder and relates particularly to those containers molded of a plastic material which include a pouring aperture cooperating with a pivotally secured tab whereby liquid may be dispensed through the pouring aperture by pivoting the tab away from its sealing position and resealed by pivoting the tab to a closed position.

(2) Prior Art

With the advent of disposable plastic containers for selling and distributing liquid products such as shampoos, soaps, cosmetics and the like, practitioners in the container design arts have employed a number of systems in an attempt to provide an easily utilized container having an attractive appearance. Typically, the liquid products are sold in a molded plastic bottle which terminates on its upper end in a cylindrical neck. A molded plastic cap is usually employed to seal the bottle which includes means for attachment to the container neck in a sealing manner. In such containers the cap is removed to dispense the liquid and the container is thereafter resealed by returning the cap to the neck. In the earliest cap and container configurations, the neck supported a plurality of threads and defined a relatively large discharge aperture. Correspondingly, the cap comprised a simple closed end cylindrical member having an integral top surface and an interior thread compatible with the thread on the container neck. Container access was achieved by simply unthreading the cap from the neck and pouring the liquid from the container to the neck. Conversely the container was resealed by simply threading the cap back upon the neck until the upper portion of the container neck engaged a receiving surface on the cap interior affecting a seal.

As practitioners in the art became more and more adept at container design and production, there evolved various variations and improvements directed toward increasing the consumer appeal of the product by improving the ease of container uses. For example, one structure provides a simple slide member valve supported on the cap which is moveable between a first position affecting sealing and slidably moveable to a second position in which a pouring aperture is unabstructed. This system is most commonly utilized in dispensers of soap, shampoos and the like. Another frequently used container system employs a cap which comprises a molded plastic cap having a generally flat top surface and a generally cylindrical side depending therefrom to form a closed internal cavity. In most cases, the interior sides of the cap are threaded to cooperate with the external neck threads on a container to secure the cap to the container neck, in a manner similar to the prior devices described above. The improvement provides a cap which can be opened and closed without removal from the neck. A pivotally mounted tab member is secured to the top portion of the cap and may be pivoted to a first position in which the tab member is seated within a receiving channel formed in the top of the cap. The receiving channel is generally configured to receive the entire tab member in the closed position thereby providing a generally flush top surface on the cap. The tab member may also be pivoted to a second position in which the tab assumes a obtuse angle with the top surface of the cap. The cap channel, which receives the tab, further defines a small pouring aperture while the mating surface of the pivotable tab defines a downwardly extending plug member configured to fit within and form a seal of the small aperture when the tab is placed in the flush position.

The use of such tab type caps for containers storing soaps, shampoos and the like have provided a considerable improvement in the ease of use and consumer appeal over prior devices requiring cap removal and have enjoyed substantial consumer acceptance and appreciation. However, particularly when used with soaps, shampoos and other liquids which tend to have very high lubricating properties, a problem has arisen in that the repeated use of the tabbed cap causes the liquid to collect around the supporting hinge of the tab. Since the supporting hinge is the sole means of attachment between the tab and the cap, the lubrication of the hinge attachment resulting, frequently causes the tab to become unintentionally separated from the cap. This separation often occurs while the tab is being moved between its two operable positions and is annoying to consumers.

There remains therefore a need in the art for an improved tab style cap structure which better resists the tendency to loosen and disengage in use with liquids having a high lubrication property.

SUMMARY OF THE INVENTION

It is a general object of the present invention to provide an improved tab sealable cap structure. It is a more particular object of the present invention to provide an improved tab sealing cap structure for use with high lubrication liquids, such as soaps, shampoos and the like in which the hinge structure has a greater resistence to separation of the tab from the cap.

Accordingly, the invention provides an improved container cap having a generally closed cap portion defining a sealing cavity, which in turn defines a pouring aperture therethrough. A pivotally mounted tab is secured to the cap and defines a plug extension configured to fit within and form a sealing engagement with the pouring aperture. A tab securing hinge defines a pair of inwardly facing concave sockets, while the cap portion of the hinge defines a corresponding pair of convex spherical ball surfaces oriented with respect to the hinge mounting to nest within the socket cavities and secure the tab in a pivotal manner. A pair of grooves are defined in the cap top and are oriented beneath the hinge members within the cap defining a curvature which generally conforms to the pivoting path of the tab member and portion. A pair of times extend outwardly from the hinge support end of the tab which are oriented so as to extend into and travel within the grooves. The tines extend into the grooves a sufficient distance to secure the tab laterally with respect to the hinge regardless of tab position. The grooves terminate in a shoulder surface which cooperates with the tines to limit the downward travel of the tab.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings in the several figures of which like reference numerals identify like elements, and in which:

FIG. 1 is a perspective view of a container cap constructed in accordance with the present invention showing the tab in the open position;

FIG. 2 is a perspective view of the present invention container cap with the tab rotated in the closed position;

FIG. 3 is a sectioned view of the present invention container cap taken along section lines 3—3 of FIG. 2; and FIG. 4 is a perspective assembly view of a container cap constructed in accordance with the present invention.

DESCRIPTION OF THE INVENTION

FIG. 1 shows a perspective view of a container cap constructed in accordance with the present invention. A generally cylindrical barrel 11 and a generally planar top 12 are integrally formed of a molded plastic material. Barrel 11 further defines a lower rim 13. Top 12 defines a tab cavity 14 comprising a generally rectangular recess extending inwardly from Barrel 11 across top 12 to a point approximately at the center of top 12. Tab cavity 14 further defines a transverse lip 15 extending across and forming the outer edge of tab cavity 14 and a pair of substantially parallel side members 16 and 17 extending perpendicular to lip 15 and inwardly on top 12. Tab cavity 14 terminates on its inner edge in an inclined surface rest 30 (better seen in FIG. 2). Tab cavity 14 also defines a generally circular pouring aperture 20 and a surrounding raised rim 19. As is better seen in FIG. 3, pouring aperture 20 extends through top 12 and provides access to the interior of container 14. The lower surface of tab cavity 14 terminates in a substantially planar floor 18 which is recessed from top 12 by a distance approximately equal to the thickness of rib 27 of tab 21. A generally planar tab 21 defines an outer edge 23 and a pair of straight ribs 26 and 27 which are mutually parallel and substantially perpendicular to edge 23. Ribs 27 and 26 terminate on their ends remote from edge 23 in a pair of parallel hinge flanges 29. Hinge flanges 29 are of generally disk-like shape and, as shall be set forth below in greater detail, form the pivot supports of the mounting machine pivotally securing tab 21 within tab cavity 14. Tab 21 further defines a transverse brace 28 extending perpendicular to ribs 26 and 27. A lip portion 22 extends from brace 28 to edge 23 of tab 21 and is of generally planar construction and of a thickness approximately equal to the thickness of sides 16 and 17 overlying lip 15 in top 12. A generally cylindrical plug 24, defining an interior cavity 25, extends from surface 42 of tab 21 and is substantially perpendicular thereto. Plug 24 is spaced from the common axis of hinge flanges 29 by a distance equal to the distance from the common axis of hinge flanges 29 and the centerline of pouring aperture 20 when tab 21 is in the closed position (shown in FIG. 2). Accordingly, and as will be described below in greater detail, plug 24 of tab 21 extends into and through pouring aperture 20 in a sealing engagement when tab 21 is rotated to its closed position. The details of construction of the hinge mechanism pivotally supporting tab 21 in its engagement to top 12 within tab cavity 14, are set forth below in greater detail. However, suffice it to note here that tab 21 pivots about the common axis of hinge flanges 29 due to their pivotal engagement within tab cavity 14 permitting plug 24 to be withdrawn from pouring aperture 20. The position of tab 21 with plug 24 withdrawn from aperture 20 defines the "open" position of cap 10 in which liquid within container 40 may be discharged through pouring aperture 20.

With reference now to FIG. 2 which shows cap 10 having tab 21 pivoted to the closed position, it should be noted that edge 23 of tab 21 extends beyond the periphery of barrel 11. It should be further noted that in the closed position of FIG. 2, the top surface of tab 21 is substantially parallel to and flush with top 12 of cap 10. As mentioned with tab 21 in its closed position, the inclined surface of rest 30 is readily seen. In accordance with a substantial advantage to consumers and with importance to the present invention, it should be noted that the extension of edge 23 beyond the periphery of barrel 11 facilitates opening of cap 10 by the consumer through the sliding action of a thumb or finger along barrel 11 from a point beneath edge 23 upwardly until the finger or thumb encounters edge 23. Thereafter, continued sliding motion raises edge 23 from top 12 and pivots tab 21 toward the position shown in FIG. 1. Pivoting of tab 21 in turn withdraws sealing plug 24 from pouring aperture 20. As will be discussed below in greater detail, the process of opening tab 21 results in imposing substantial stresses upon the hinge mechanism securing tab 21 to top 12. The details of construction of the present invention hinge mechanism will be discussed below in greater detail. However, suffice it to state here that the fluid discharge from container 40 through aperture 20 often results in collection of the fluid within tab cavity 14 and more importantly the region surrounding the pivotal mounting of tab 21.

FIG. 3 shows a sectioned view of the present invention container cap taken along section lines 3—3 in FIG. 2 and showing tab 21 in the closed position. In accordance with commonly accepted fabrication techniques, Barrel 11 further defines a plurality of internal cap threads 35 on its interior surface Container 40, also in accordance with commonly employed fabrication techniques, defines a generally cylindrical neck 41 having external threads 43 which cooperate with threads 35 of cap 10 to secure neck 41 within cap 10. As can be seen in FIG. 3, top 12 of cap 10 further defines a downwardly extending annular seal extension 31 which engages the upper portion of neck 41 and provides a fluid-tight seal between neck 41 and cap 10 once cap 10 is properly threaded upon neck 41. Tab 21, in the closed position shown in FIG. 3, is supported within tab cavity 14 such that edge 23 extends beyond the outer portion of lip 15 as described above in connection with FIG. 2. Lip 22 of tab 21 extends inwardly and overlies lip 15. The abutment of lip 22 and lip 15 prevents tab 21 from being driven downward during the closing action beyond the desired range of travel. Plug 24 extends downwardly from tab 21 through pouring aperture 20. Rim 19 of top 12 extends upward from floor 18 and enhances the seal between plug 24 and aperture 20 and further strengthens the area of floor 18 surrounding aperture 20. As mentioned above, hinge flanges 29 comprise a pair of disk-like members (better seen in FIGS. 1 and 4) spaced in a substantially parallel arrangement and aligned on a common centerline axis. By operation of structures shown below in greater detail, tab 21 pivots about the centerline of hinge flanges 29 from its closed position (shown in FIG. 3) upwardly and away from tab cavity 14 until the top surface 45 of tab 21 abuts rest surface 30 of top 12 (shown in FIG. 1). The engagement of surface 45 against rest 30 limits the opening travel of tab 21 in the opening direction. Top 12 defines a semicylindrical trough 46 which is generally concentric with hinge flanges 29 and which in turn defines a pair of parallel grooves 32 extending substantially across the interior surfaces of trough 46. Grooves 32 each terminate on one end in a shoulder 44. Tab 21 defines a pair of outwardly extending parallel tines 33 which are spaced inwardly from hinge flanges 29 so as to extend into grooves 32 in trough 46. With tab 21 in the closed position shown in FIG. 3, tines 33 abut shoulders 44 of grooves 32. In accordance with an important aspect of the present invention, this abutment of tines 33 with shoulders 44 further limits the travel of tab 21 in the closed direction and resists separating forces produced during tab 21 motion which might otherwise separate hinge flanges 29 from top 12. As tab 21 is pivoted from its closed position and its open position, tines 33 travel within grooves 32 and permit free pivoting action of tab 21 but restrict lateral motion of tab 21 thereby further restricting the tendency of tab 21 to separate from top 12.

FIG. 4 shows an assembly view of the present invention cap in which the details of the hinge mounting system may be more clearly seen. As mentioned above, top 12 defines tab cavity 14, pouring aperture 20 and sides 16 and 17. In addition, a pair of hinge balls 38 defining substantially spherical surfaces, extend inwardly from sides 16 and 17 adjacent grooves 32 and centered on the common axis of hinge flanges 29. Turning now to the details of tab 21 in FIG. 4, it should be noted that hinge flanges 29 each define a concave hinge socket 37. Hinge sockets 37 are of generally spherical concave contour and are sized to conform to and receive hinge balls 38 when tab 21 is assembled within tab cavity 14.

Because tines 33 extend outwardly from the common axis of hinge flanges 29, they extend into grooves 32 in top 12 and when tab 21 is assembled to top 12 of cap 10.

The cooperation of tines 33 and grooves 32 in the present invention cap, substantially inhibits the tendency of tab 21 to twist and separate from cap 10. This increased securing force is particularly important in the presence of the fluid residual in the area of hinge flanges 29 and hinge balls 38. Because tines 33 extend into grooves 32 at substantially all angular positions of tab 21, the lateral forces imposed upon tab 21 in use which tend to twist tab 21 within tab cavity 14 and would otherwise separate hinge flanges 29 from hinge balls 38, are substantially impeded by the resisting force provided by tines 33 against the sides of grooves 32. In addition, when tab 21 is positioned in its closed position, forces are imposed upon the hinge mechanism of tab 21 by the friction of plug 24 passing through pouring aperture 20. But for the action of tines 33 against shoulders 44, these forces would otherwise tend to raise hinge flanges 29 with respect to hinge balls 38 and separate tab 21 from cap 10. As can be seen in FIG. 3, those forces are resisted by the abutment of tines 33 against shoulders 44 of grooves 32. As a result, the security of tab 21 within cap 10 is substantially increased by the improvement of tines 33 and grooves 32 without any significant interference in the pivoting action of tab 21. It should also be noted that the fabrication of tines 33 and grooves 32 is achieved without an increase in the cost of either tab 21 or cap 10. As a result, a substantially improved cap structure is achieved without additional cost of manufacture or assembly.

What has been shown therefore, is a substantial improvement in the construction of a tab actuated cap for use with a container having particular advantage in use with fluids of high lubrication properties, such as soaps, shampoos and the like.

While the foregoing has illustrated and described what is now contemplated to be the best mode of carrying out the invention, the description is, of course, subject to modifications without departing from the spirit and scope of the invention. Therefore, it is not desired to restrict the invention to the particular constructions illustrated and described, but to cover all such modifications as may fall within the scope of the appended claims.

What is claimed is:

1. For use in combination with a container having an internal cavity for receiving a substance and a container neck defining a passage, therethrough, a container cap comprising:

a generally cylindrical barrel defining a first and a second end adapted to receive and be secured to said container neck;

a substantially planar sealing surface extending across said first end and defining a tab recess defining a pouring aperture and having first and second substantially parallel sidewalls, said sidewalls each defining respective first and second inwardly facing spherical ball surfaces;

a substantially planar tab configured to be received within said tab recess and defining a first and a second end, said first end defining a pair of hinge flanges each of which define an outwardly facing concave spherical socket receiving said ball surfaces to form a hinge about which said tab is pivotable between a first position within said tab recess and a second position removed from said tab recess;

at least one tine extending outwardly from said second end of said tab; and at least one groove defined in said tab recess and positioned with respect to said tine such that each of said tine extends into one of said grooves.

2. A container cap as set forth in claim 1 wherein said tab defines a pair of said tines and wherein said tab recess defines a pair of said grooves.

3. A container cap as set forth in claim 2 wherein said grooves each define a shoulder positioned such that said tines abut said shoulder when said tab is positioned in said first position.

4. A container cap as set forth in claim 3 wherein said tab defines a plug configured to be received within said pouring aperture when said tab is in said first position.

5. In a container cap having a cavity, adapted to receive the neck of a container and a sealing surface adapted to form a sealing contact with the neck of the container wherein the sealing surface defines a tab recess and a pouring aperture within the recess for transferring a substance from the container and having a tab pivotally supported within the tab recess whereby the tab is pivotable between a first position within the tab recess overlying and obstructing the pouring recess and a second position removed from the pouring recess; the improvement comprising:

a plurality of tines extending from said tab describing an arched path of motion as said tab is pivoted between said first and second positions; and a plurality of grooves defined in said tab recess corresponding to and including said arched path of motion of said plurality of tines;

said plurality of tines extending into said plurality of grooves and resisting lateral and twisting motion of said tab.

6. The improvement of claim 5 wherein said plurality of tines each define a shoulder and wherein said plurality of grooves each define a shoulder positioned at the ends of said plurality of grooves such that each of said tines in said plurality of tines abuts the shoulder of the respective groove of said plurality of grooves in which it travels once said tab is pivoted to said first position.

7. The improvement set forth in claim 6 wherein said tab defines a pair of sockets and said tab recess defines a pair of ball extensions engaging and resting within said sockets to form a pair of ball and socket hinges about which said tab pivots and wherein said plurality of tines define a pair of tines spaced with said sockets and said plurality of grooves define a pair of grooves spaced to receive said pair of tines.

* * * * *